US009020400B2

(12) United States Patent
Furuta

(10) Patent No.: US 9,020,400 B2
(45) Date of Patent: Apr. 28, 2015

(54) IMAGE FORMING APPARATUS FOR FORMING A MEASUREMENT IMAGE

(71) Applicant: Canon Kabushiki Kaisha, Tokyo (JP)

(72) Inventor: Yasutomo Furuta, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/970,452

(22) Filed: Aug. 19, 2013

(65) Prior Publication Data

US 2014/0056601 A1 Feb. 27, 2014

(30) Foreign Application Priority Data

Aug. 21, 2012 (JP) ..... 2012-182533

(51) Int. Cl.
*G03G 15/00* (2006.01)
*G03G 21/20* (2006.01)

(52) U.S. Cl.
CPC ..... *G03G 15/5062* (2013.01); *G03G 21/20* (2013.01)

(58) Field of Classification Search
CPC combination set(s) only.
See application file for complete search history.

(56) References Cited

FOREIGN PATENT DOCUMENTS

JP 2004-086013 A 3/2004

*Primary Examiner* — Clayton E Laballe
*Assistant Examiner* — Jas Sanghera
(74) *Attorney, Agent, or Firm* — Canon USA Inc. IP Division

(57) ABSTRACT

An image forming apparatus includes a measurement unit configured to irradiate a measurement image with light, and measure the light reflected from the measurement image, a white reference plate disposed in a position opposite to the measurement unit, a correction unit configured to correct a measurement result of the measurement image, based on a measurement result of the white reference plate acquired by the measurement unit, and a temperature detection unit configured to detect temperature in a vicinity of the measurement unit, wherein the correction unit corrects, in a case where a difference between a temperature detected by the temperature detection unit and a temperature shown when previously measuring the white reference plate is less than a predetermined value, a measurement result of the measurement image using a previous measurement result of the white reference plate without measuring the white reference plate with the measurement unit.

20 Claims, 8 Drawing Sheets

IMAGE FORMING APPARATUS FOR FORMING A MEASUREMENT IMAGE

BACKGROUND OF THE INVENTION

1. Field of the Invention

The present disclosure generally relates to imaging and, more particularly, to an image forming apparatus having a function of measuring colors of a measurement image.

2. Description of the Related Art

Image quality of the image forming apparatus includes granularity, in-plane uniformity, text quality, and color reproducibility (including color stability). In recent years in which a multi-color image forming apparatus has become widely used, the color reproducibility in some cases is the most significant image quality.

Humans have a memory of expected colors (in particular, of a human skin, blue sky, and metal) based on experience, and if a color exceeds an allowable range of such an expected color, a viewer develops a feeling of strangeness. Such colors are referred to as memory colors, and reproducibility of the memory color has become a concern when outputting a photograph.

Further, an increase in the demand for the color reproducibility (including image stability) with respect to the image forming apparatus is not limited to that of the photographic image. In the case of a document image, there is an increasing demand from office users who feel discomfort in a color difference between the output from the image forming apparatus and that on a monitor, and from graphic artists who pursue color reproducibility of a computer graphics (CG) image.

To satisfy such user demands for the color reproducibility, Japanese Patent Application Laid-Open No. 2004-086013 discusses an image forming apparatus which reads, using a measurement unit (i.e., a color sensor) disposed in a conveyance path of a sheet, the measurement image (i.e., a patch image) formed on the sheet. Such an image forming apparatus feeds back into process conditions such as an exposure amount and a developing bias, a result obtained by the color sensor reading the patch image. Constant density, gradation, and tint can thus be reproduced.

However, detection accuracy of a color value by the color sensor discussed in Japanese Patent Application Laid-Open No. 2004-086013 becomes degraded by an output fluctuation of a light source due to a change in environmental temperature. To solve such a problem, calibration may be performed by arranging a white reference plate in a position opposite to the color sensor, so that the color sensor measures the white reference plate, and corrects a detection value of the color sensor.

More specifically, spectral reflectivity $R(\lambda)$ of the patch image may be obtained as $R(\lambda)=P(\lambda)/W(\lambda)$, wherein $W(\lambda)$ is reflected light from the white reference plate, and $P(\lambda)$ is the reflected light from the patch image.

If the spectral reflectivity of the patch image is obtained using the white reference plate, a problem may occur in which there is discoloring of the white reference plate due to irradiation of light so that an error is generated in the measurement value. When the white reference plate contains a material which is discolored by an oxidation effect of light, the discoloring occurs in the white reference plate irradiated with light.

Since the white reference plate is irradiated with light while performing calibration, the discoloring gradually progresses during irradiation of the light in each calibration. As a result, the error in the measurement value gradually increases.

SUMMARY OF THE INVENTION

The present disclosure is directed to an image forming apparatus which reduces discoloring of a white reference plate due to irradiation with light, and maintains measurement accuracy over a long period.

According to an aspect of the present disclosure, an image forming apparatus includes an image forming unit configured to form a measurement image on a sheet, a measurement unit configured to irradiate the measurement image with light, and measure the light reflected from the measurement image, a white reference plate disposed in a position opposite to the measurement unit, a correction unit configured to correct a measurement result of the measurement image, based on a measurement result of the white reference plate acquired by the measurement unit, and a temperature detection unit configured to detect temperature in a vicinity of the measurement unit, wherein the correction unit corrects, in a case where a difference between a temperature detected by the temperature detection unit and a temperature shown when previously measuring the white reference plate is less than a predetermined value, a measurement result of the measurement image using a previous measurement result of the white reference plate without measuring the white reference plate with the measurement unit.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles of the disclosure.

DESCRIPTION OF THE EMBODIMENTS

Various exemplary embodiments, features, and aspects of the disclosure will be described in detail below with reference to the drawings.

(The Image Forming Apparatus)

According to an exemplary embodiment of the present disclosure, a means for solving the above-described problem will be described below employing an electrophotographic laser beam printer. The electrophotographic method is an example of an image forming method, and an inkjet method and a sublimation method are also applicable to the present disclosure. When the inkjet method is employed, an image forming unit which discharges ink and forms the image on the sheet, and a fixing unit (i.e., a drying unit) for drying the ink, are used.

Figure 1:
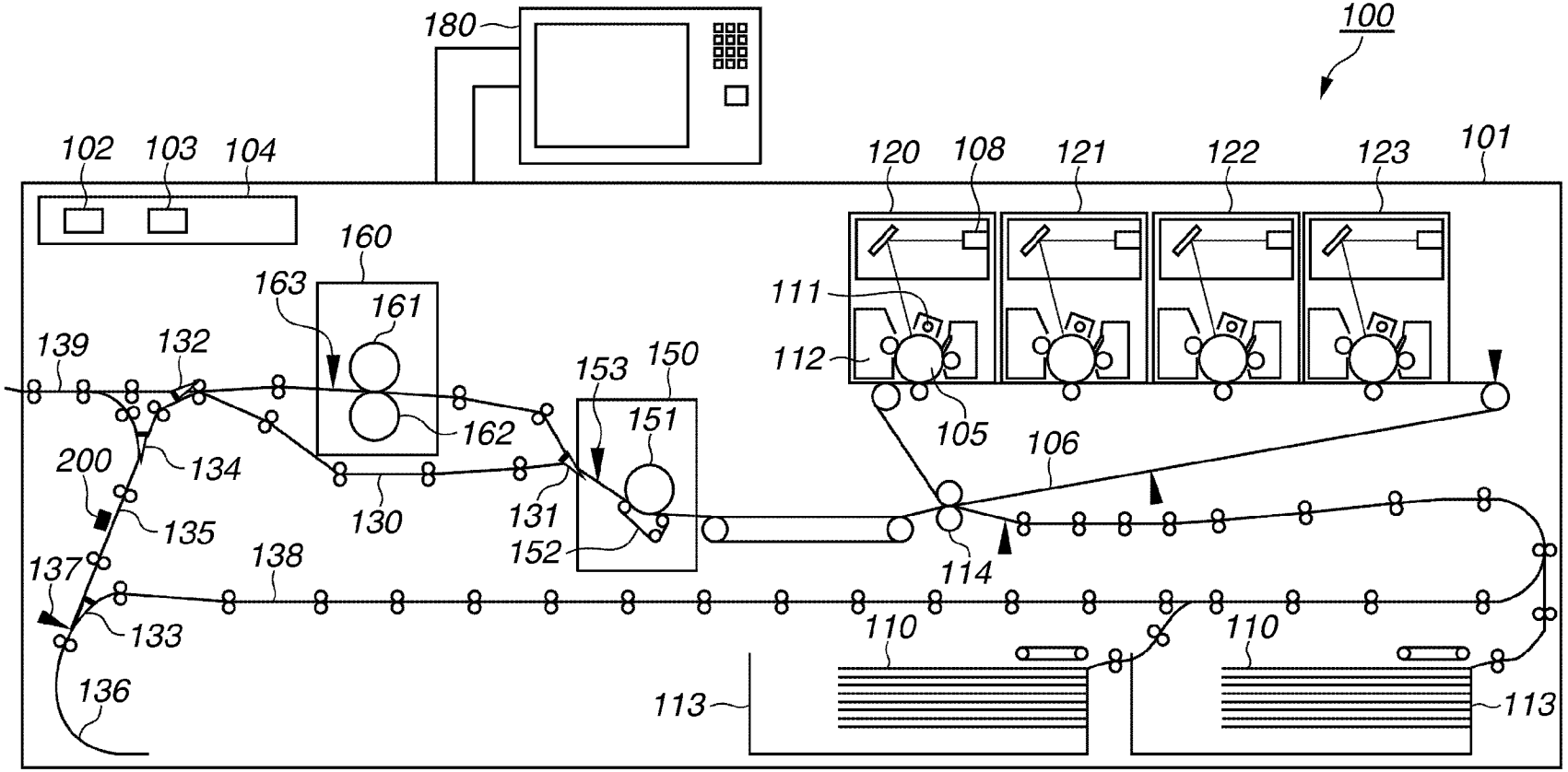
FIG. 1 is a cross-sectional view illustrating a structure of an image forming apparatus.

FIG. 1 is a cross-sectional view illustrating the structure of an image forming apparatus 100. Referring to FIG. 1, the image forming apparatus 100 includes a housing 101 in which mechanisms for configuring an engine unit, and a control board storing unit 104, are disposed. The control board storing unit 104 stores an engine control unit 102 which controls print processing (e.g., paper feeding) performed by each mechanism, and a printer controller 103.

The engine unit includes four stations 120, 121, 122, and 123, corresponding to yellow (Y), magenta (M), cyan (C), and black (K) as illustrated in FIG. 1. The stations 120, 121, 122, and 123 are the image forming units which transfer toner to a sheet 110 and forms the image, and are configured by almost common parts. A photosensitive drum 105 is an image bearing member, and a primary charging device 111 charges a surface of the photosensitive drum 105 to be at a uniform potential. A laser 108 emits a laser beam and forms a latent image on the photosensitive drum 105. A developing device 112 uses the color materials (i.e., the toner) to develop the latent image, and thus forms a toner image. The toner image (i.e., a visible image) is then transferred to an intermediate transfer member 106. A transfer roller 114 transfers the visible image formed on the intermediate transfer member 106 to the sheet 110 conveyed from a storing unit 113.

According to the present exemplary embodiment, a fixing mechanism includes a first fixing unit 150 and a second fixing unit 160 which heat and press the toner image transferred to the sheet 110 and thus fix the toner image on the sheet 110. The first fixing unit 150 includes a fixing roller 151 for applying heat to the sheet 110, a pressing belt 152 for press-contacting the sheet 110 to the fixing roller 151, and a first fixing sensor 153 for detecting whether fixing is completed. The fixing roller 151 is a hollow roller and includes a heater therein.

The second fixing unit 160 is disposed downstream in a conveyance direction of the sheet 110 from the first fixing unit 150. The second fixing unit 160 applies gloss to the toner image on the sheet fixed by the first fixing unit 150, and secures fixability. The second fixing unit 160 includes a fixing roller 161, a pressing roller 162, and a second fixing sensor 163 similarly as the first fixing unit 150. It may become unnecessary to pass the sheet 110 through the second fixing unit 160, depending on the type of the sheet 110. In such a case, the sheet 110 passes through a conveyance path 130 without passing through the second fixing unit 160 to reduce energy consumption.

For example, if a setting is made to apply a large amount of gloss to the toner image on the sheet 110, or a large amount of heat is necessary for fixing the toner image on a cardboard, the sheet passing through the first fixing unit 150 is conveyed to the second fixing unit 160. On the other hand, if the sheet 110 is plain paper or thin paper, and application of a large amount of gloss is not set, the sheet 110 is conveyed on the conveyance path 130 which bypasses the second fixing unit 160. A switching member 131 controls whether to convey the sheet 110 to the second fixing unit 160, or convey the sheet 110 bypassing the second fixing unit 160.

A switching member 132 is a guiding member for guiding the sheet 110 to a conveyance path 135 or to a discharge path 139 leading to the outside. A leading edge of the sheet guided to the conveyance path 135 passes through a reversing sensor 137 and is conveyed to a reversing unit 136. When the reversing sensor 137 detects a trailing edge of the sheet 110, the conveyance direction of the sheet 110 is switched. A switching member 133 is a guiding member for guiding the sheet 110 to a conveyance path 138 for forming the images on two sides of the sheet 110, or the conveyance path 135.

A color sensor 200 for detecting the measurement image (hereinafter referred to as the patch image) on the sheet 110 is arranged in the conveyance path 135. Four sensors 200*a*, 200*b*, 200*c*, and 200*d* (illustrated in FIG. 5) in the color sensor 200 are aligned in the direction perpendicular to the conveyance direction of the sheet 110, so that the color sensor 200 is capable of detecting 4 columns of patch images. If the user instructs color detection from an operation unit 180, the engine control unit 102 performs density control, gradation control, and multi-layered color control. The engine control unit 102 measures the density of a single-color measurement image in performing the density adjustment and the gradation adjustment, and measures the color of the measurement image in which a plurality of colors are superimposed, in performing the multi-layered color adjustment.

A switching member 134 is a guiding member for guiding the sheet 110 to the discharge path 139 leading to the outside. The sheet 110 conveyed to the discharge path 139 is discharged to the outside of the image forming apparatus 100.

(The Color Sensor)

Figure 2:
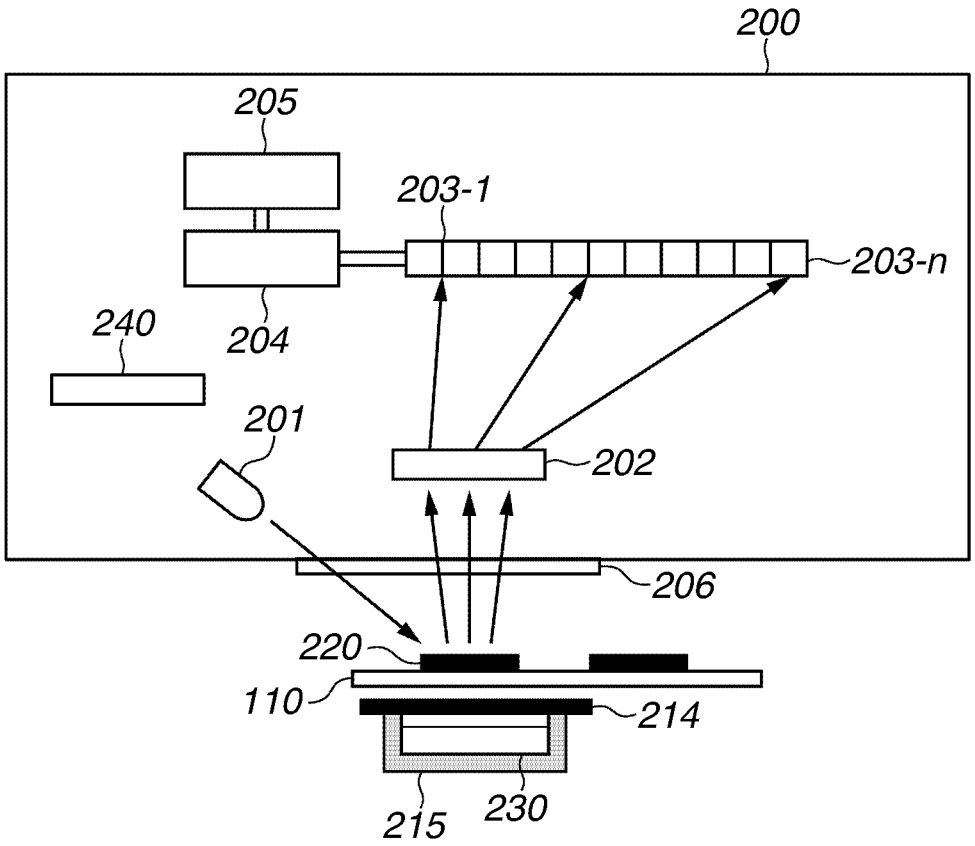
FIG. 2 illustrates a state of a color sensor when measuring the patch image.

FIG. 2 illustrates the configuration of the color sensor 200. Referring to FIG. 2, the color sensor 200 includes a white light-emitting diode (LED) 201, a diffraction grating 202, a line sensor 203, a calculation unit 204, and a memory 205. The white LED 201 is a light-emitting element which irradiates with light a patch image 220 on the sheet 110. The light reflected by the patch image 220 passes through a window 206 configured of a transparent member.

The diffraction grating 202 separates the light reflected from the patch image 220 into respective wavelengths. The line sensor 203 is a light detecting element including n light-receiving elements that detect the light separated into the respective wavelengths by the diffraction grating 202. The calculation unit 204 performs various calculations using a light intensity value of each pixel detected by the line sensor 203.

A memory 205 stores various data used by the calculation unit 204. For example, the calculation unit 204 includes a spectral calculation unit which calculates spectral reflectivity from the light intensity value. Further, a lens which focuses the light emitted from the white LED 201 on the patch image 220 on the sheet 110, or focuses the light reflected from the patch image 220 on the diffraction grating 202 may be disposed. A thermistor 240, i.e., a temperature detection unit, is disposed on a substrate on which the white LED 201 is arranged, and detects the temperature of the color sensor 200.

According to the present exemplary embodiment, calibration of the color sensor 200 is performed by measuring the light reflected from the white reference plate 230. More specifically, in the calibration process, the LED 201 irradiates the white reference plate 230 with light, and the line sensor 203 detects the light reflected from the white reference plate 230, so that a light amount of the LED 201 is adjusted and the spectral reflectivity is calculated.

A white reference plate 230 is a member disposed in a position opposite to the color sensor 200, and is read by the color sensor 200 when performing white correction. The white reference plate 230 is held by a holding member 215. The white reference plate 230 is positioned so that a relative distance with respect to the color sensor 200 becomes fixed by press-contacting the holding member 215 against a metal plate.

It is desirable that the white reference plate 230 has high light resistance and strength to reduce aging degradation. An example of a material of the white reference plate 230 is ceramic-processed aluminum oxide. A shutter 214 is a black-colored protection member which is moved to a position covering the white reference plate 230 to prevent discoloring of the white reference plate 230 caused by the irradiation with light, and soiling of the white reference plate 230.

More specifically, when calibration is not performed, the shutter 214 covers and thus protects the surface of the white reference plate 230. As illustrated in FIG. 2, the shutter 214 also covers the surface of the white reference plate 230 when the patch image 220 is measured.

Figure 3:
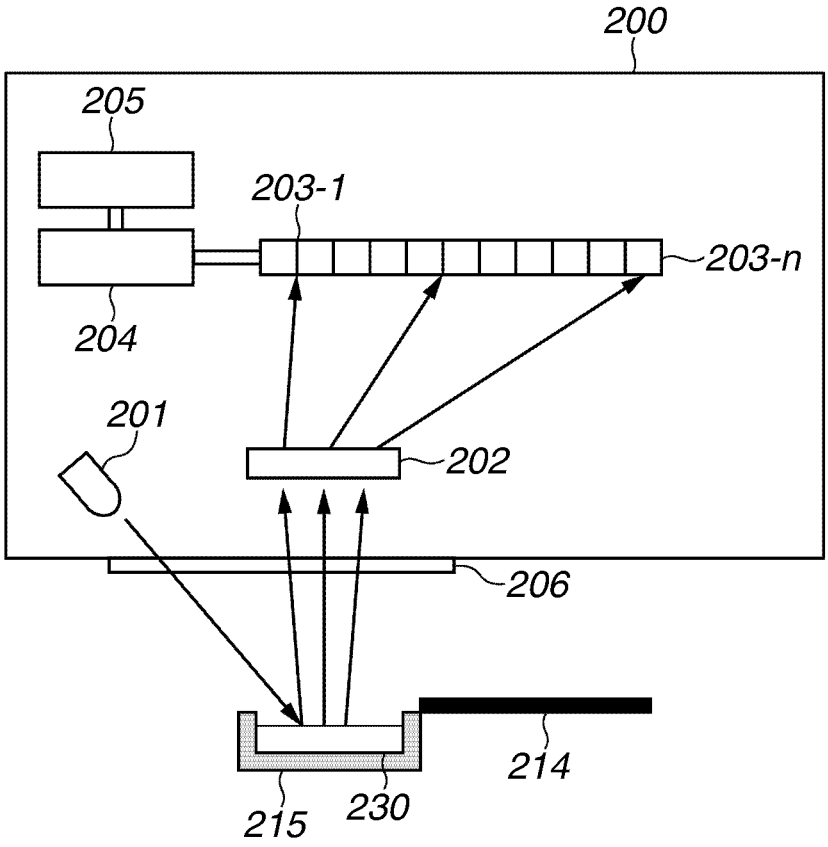
FIG. 3 illustrates the state of the color sensor when measuring the white reference plate.
Figure 4:
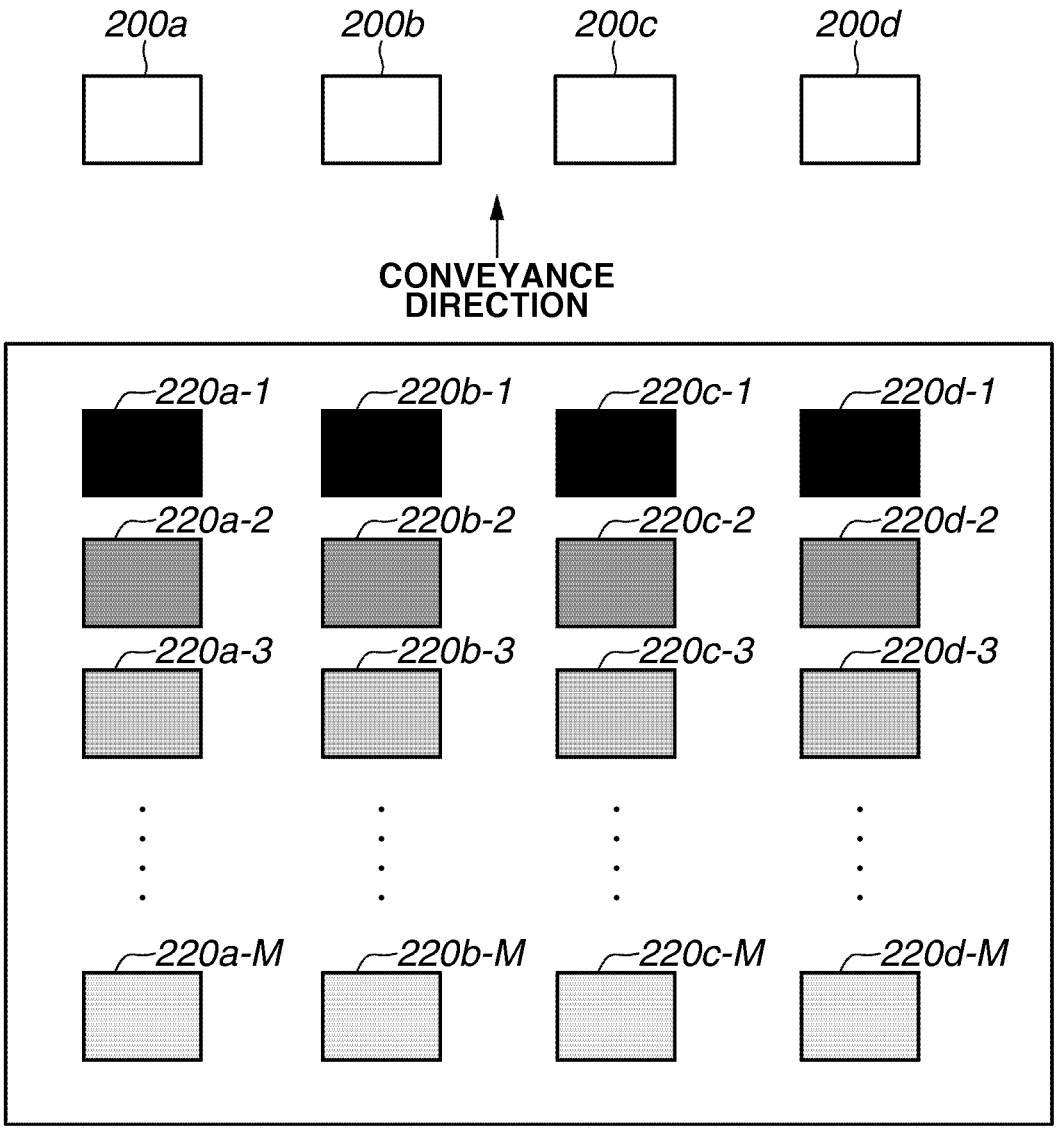
FIG. 4 illustrates an image of a color measurement chart.

On the other hand, when the color sensor 200 receives the light reflected from the white reference plate 230 and calibration is performed, the shutter 214 moves and exposes the surface of the white reference plate 230 as illustrated in FIG. 3.

(Profile)

When the image forming apparatus 100 performs multi-layered color correction, the image forming apparatus 100 generates an International Color Consortium (ICC) profile to be described below, from the detection result of the patch image including multi-layered colors. The image forming apparatus 100 then uses the profile to convert an input image, and forms an output image.

Figure 5:
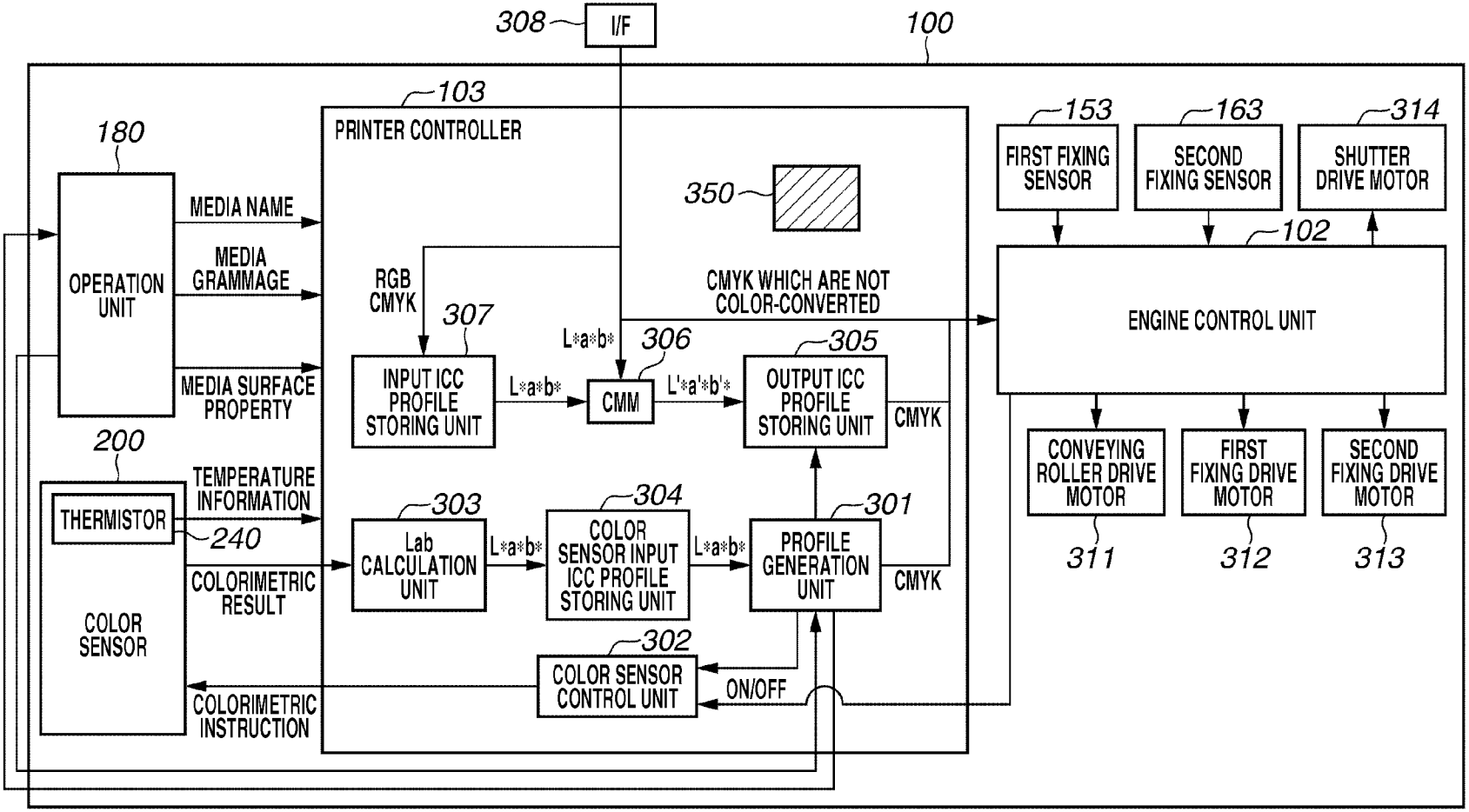
FIG. 5 is a block diagram illustrating a system configuration of the image forming apparatus.

Referring to FIG. 5, a dot area ratio of the patch image 220 including multi-layered colors is changed in three levels (i.e., 0%, 50%, and 100%) for each of the four CMYK colors. The patch images of all combinations of the dot area ratios for each color are thus generated. As illustrated in FIG. 5, the patch images 220 (i.e., patch images 220*a*-1, 220*b*-1, 220*c*-1, 220*d*-1, . . . 220*a*-M, 220*b*-M, 220*c*-M, and 220*d*-M) are formed to be arranged in four columns to be read by each of the color sensors 200*a*, 200*b*, 200*c*, and 200*d*.

The ICC profile which is recently being accepted in the market is used as the profile which realizes excellent color reproducibility. However, the present disclosure is not limited to the ICC profile, and may be applicable to Color Rendering Dictionary (CRD) employed since PostScript level 2 and a color conversion table in Photoshop (registered trademark) advocated by Adobe Corporation.

When a customer engineer replaces a component, or when a job requiring color matching accuracy is to be executed, or when the user desires to know the tint of an output product in a design planning stage, the user operates the operation unit 180 and instructs generation of the color profile.

Figure 6:
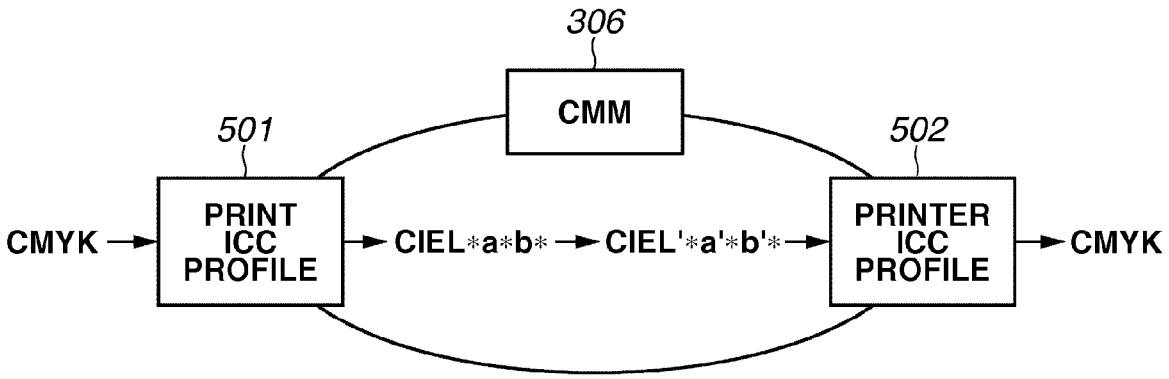
FIG. 6 is a schematic diagram illustrating a color management environment.

The profile generation process is performed by the printer controller 103 illustrated in the block diagram of FIG. 6. Referring to FIG. 6, the printer controller 103 which includes a central processing unit (CPU) reads from a storing unit 350 and executes programs for executing the flowcharts described below. The inside of the printer controller 103 are expressed by blocks for ease of understanding the processes to be performed by the printer controller 103.

When the operation unit 180 receives the instruction to generate the profile, a profile generation unit 301 outputs to the engine control unit 102, a CMYK color chart 210, i.e., an International Organization for Standardization (ISO) 126402 test form, without using the profile. The profile generation unit 301 then transmits a measurement instruction to a color sensor control unit 302. The engine control unit 102 controls the image forming apparatus 100 and executes the processes such as charging, exposing, developing, transferring, and fixing. As a result, the ISO126402 test form is formed on the sheet 110. The color sensor control unit 302 then controls the color sensor 200 to measure the ISO126402 test form. The color sensor 200 outputs to a Lab calculation unit 303 in the printer controller 103, spectral reflectivity data which is the measurement result. The Lab calculation unit 303 converts the spectral reflectivity data to color value data (i.e., L*a*b* data), and outputs the converted data to the profile generation unit 301. In this case, the L*a*b* data output from the Lab calculation unit 303 is converted using an input ICC profile for color sensor stored in a color sensor input ICC profile storing unit 304. The Lab calculation unit 303 may convert the spectral reflectivity data to Commission Internationale de l'Eclairage (CIE) 1931XYZ color system, i.e., a color space signal independent of a device.

The profile generation unit 301 generates an output ICC profile from a relationship between a CMYK color signal output to the engine control unit 102 and the L*a*b* data input from the Lab calculation unit 303. The profile generation unit 301 then stores the generated output ICC profile in an output ICC profile storing unit 305.

The ISO12642 test form includes the patches of the CMYK color signals which cover an entire color reproduction gamut that can be output by a general copying machine. As a result, the profile generation unit 301 generates a color conversion table from the relationship between each of the color signal values and the measured L*a*b* values. The profile generation unit 301 thus generates the CMYK-to-Lab conversion table. A reverse conversion table is then generated based on the conversion table.

Upon receiving a profile generation command from a host computer via an interface (I/F) 308, the profile generation unit 301 outputs to the host computer via the I/F 308 the generated output ICC profile. The host computer can perform color conversion corresponding to the ICC profile, by executing an application program.

A first fixing drive motor 312 drives the first driving unit 150, and a second fixing drive motor 313 drives the second fixing unit 160. The engine control unit 102 controls the first fixing drive motor 312 and the second fixing drive motor 313. Further, the engine control unit 102 controls a shutter drive motor 314 which moves the shutter 214. Furthermore, the printer controller 103 receives temperature information from the thermistor 240 in the color sensor 200.

(Color Conversion)

When the color conversion process is performed for a normal color output, an input image signal is transmitted to an input ICC profile storing unit 307 for external input. The input image signal is based on red (R), green (G), and blue (B) signal values input from a scanner unit via the I/F 308, or standard printing CMYK signal values such as JapanColor. The input ICC profile storing unit 307 then performs RGB-to-L*a*b* or CMYK-to-L*a*b* conversion according to the image signal input from the I/F 308. The input ICC profile stored in the input ICC profile storing unit 307 is configured of a plurality of lookup tables (LUT).

More specifically, the plurality of LUT include a one-dimensional LUT which controls a gamma value of the input signal, a multi-layered color LUT referred to as direct mapping, and the one-dimensional LUT which controls the gamma value of the generated converted data. The input image signal is converted from device-dependent color space data to the device-independent L*a*b* data using the above-described LUT.

The image signal converted to L*a*b* coordinates is input to a color management module (CMM) 306. The CMM 306 performs various types of color conversion. For example, the CMM 306 performs gamut conversion which maps a mismatch between a color space read by the scanner unit, i.e., an input device, and an output color reproduction range of the image forming apparatus 100, i.e., an output device. Further, the CMM 306 performs color conversion which adjusts the mismatch between the type of light source used in inputting the data, and the type of light source used when observing an output product (i.e., the mismatch in a color temperature setting).

As described above, the CMM 306 converts the L*a*b* data to L'*a'*b'* data, and outputs the converted data to the output ICC profile storing unit 305. The output ICC profile storing unit 305 stores the profiles generated by performing measurement. The output ICC profile storing unit 305 thus performs color conversion of the L'*a'*b'* data using the newly generated ICC profile, i.e., coverts the data to an output device-dependent CMYK signal, and outputs the CMYK signal to the engine control unit 102.

Referring to FIG. 5, the input ICC profile storing unit 307 and the output ICC profile storing unit 305 in the CMM 306 are separated. However, the CMM 306 is a module which controls color management as illustrated in FIG. 6, and performs color conversion using the input profile (i.e., a print ICC profile 501), and the output profile (i.e., a printer ICC profile 502).

(Calibration of the Color Sensor)

Figure 7:
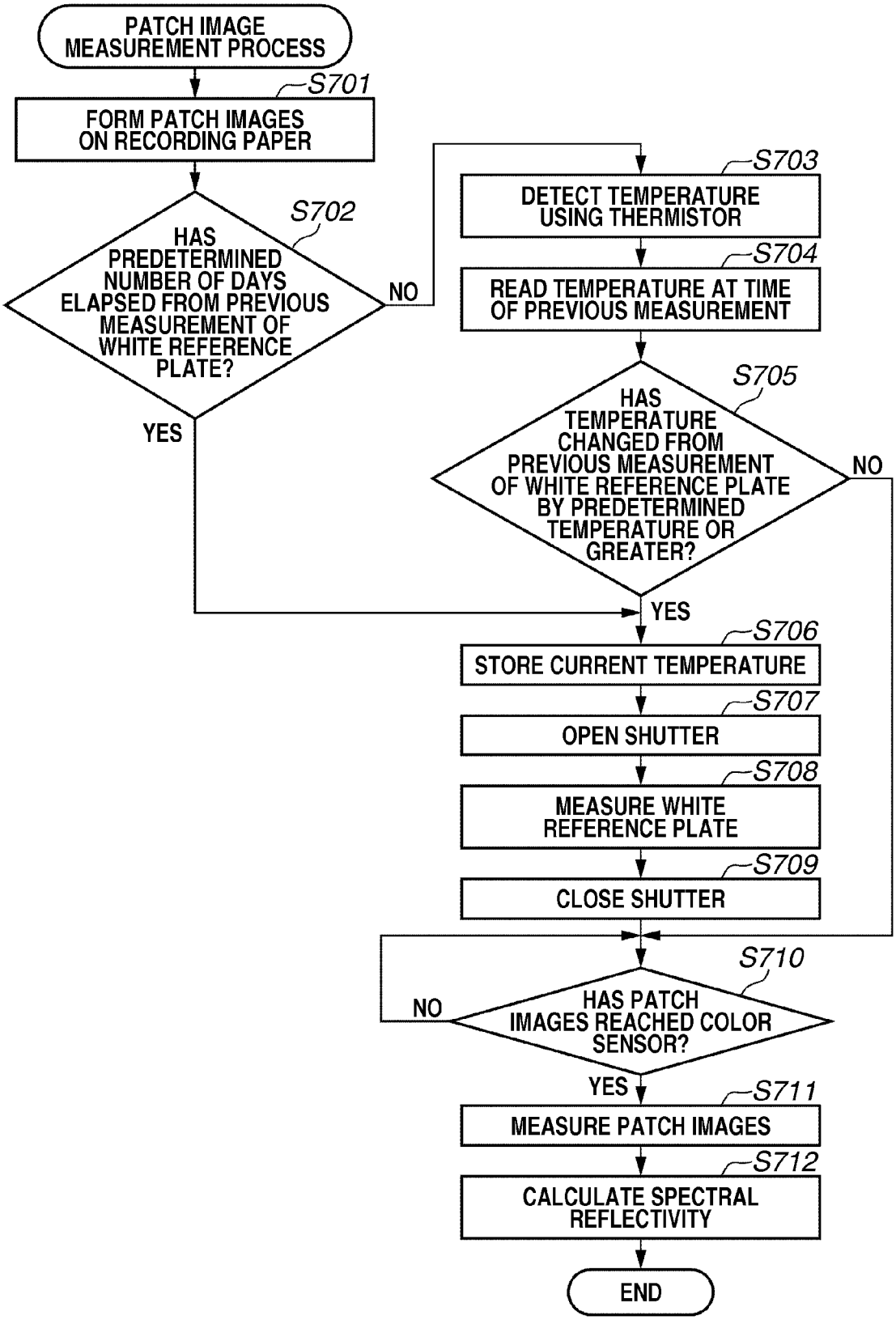
FIG. 7 is a flowchart illustrating the process for measuring a chart on which patch images 220 are formed.

FIG. 7 is a flowchart illustrating the process for measuring the chart on which the patch images are formed.

The process of the flowchart illustrated in FIG. 7 is executed by the printer controller 103. The engine control unit 102 controls the image forming apparatus 100 according to an instruction from the printer controller 103.

When the user or an operator operating the operation unit 180 instructs to start measurement of the color measurement chart, the process of the flowchart illustrated in FIG. 7 is executed. In step S701, the printer controller 103 issues an instruction to the engine control unit 102 to start forming the path images 220 on the sheet 110. In step S702, the printer controller 103 determines whether a predetermined period (i.e., a predetermined number of days) has elapsed from the previous measurement of the white reference plate 230. The predetermined number of days is a number which is previously determined based on a relation between irradiation with light and discoloring of the white reference plate 230. According to the present exemplary embodiment, the predetermined number of days is set to 30 days.

If a predetermined number of days has elapsed from the previous measurement of the white reference plate 230 (YES in step S702), the process proceeds to step S706. On the other hand, if a predetermined number of days has not elapsed from the previous measurement of the white reference plate 230 (NO in step S702), the process proceeds to step S703. In step S703, the printer controller 103 uses the thermistor 240 and detects the current temperature of the color sensor 200. In step S704, the printer controller 103 reads from the storing unit 350 the temperature shown when previously measuring the white reference plate 230.

In step S705, the printer controller 103 compares the current temperature detected in step S703 and the temperature shown when previously measuring the white reference plate 230 read in step S704, and determines whether the temperature has changed by a predetermined value or more. In other words, the printer controller 103 compares the current temperature and the temperature shown when previously measuring the white reference plate 230 to determine whether the output fluctuation has occurred in the LED 201 due to the temperature change.

If the temperature has not changed by a predetermined value or more (NO in step S705), the process proceeds to step S711. If the temperature has changed by a predetermined value or more (YES in step S705), the process proceeds to step S706. In step S706, the printer controller 103 stores in the storing unit 350 the current temperature detected in step S703. In step S707, the printer controller 103 instructs the engine control unit 102 to drive the shutter drive motor 314 and open the shutter 214. In step S707, the printer controller 103 uses the color sensor 200 to measure the white reference plate 230. The printer controller 103 stores the measurement value in the memory 205 as W (λ). Further, the printer controller 103 stores a measurement date in the storing unit 350.

In step S709, the printer controller 103 instructs the engine control unit 102 to drive the shutter drive motor 314 and close the shutter 214. In step S710, the printer controller 103 stands by until the sheet 110 (i.e., the color measurement chart) on which the patch images 220 have been formed reaches the color sensor 200. In step S711, when the chart reaches the color sensor 200, the printer controller 103 uses the color sensor 200 to measure the patch images 220. The printer controller 103 then stores the measurement value in the memory 205 as P (λ).

In step S706, the printer controller 103 calculates the spectral reflectivity of the patch images 220 using the calculation unit 204 in the color sensor 200. The spectral reflectivity R (λ) is obtained by a formula R (λ)=P (λ)/W (λ). In other words, the spectral reflectivity R (λ) is obtained by correcting the measurement result P (λ) of the patch images 220 by the measurement result W (λ) of the white reference plate 230.

The process of the flowchart is ended as described above. If multi-layered color correction is to be performed, it is actually necessary to measure patch images of three charts, so that the printer controller 103 repeats the above-described process three times.

By performing the above-described process, if a predetermined number of days or more has elapsed from the previous measurement of the white reference plate 230, the white reference plate 230 is newly measured, and calibration of the color sensor 200 is performed. Further, if the temperature has changed from the previous measurement by a predetermined value or more, the white reference plate 230 is newly measured, and calibration of the color sensor 200 is performed.

If the time which has elapsed from the previous measurement is within a predetermined period, and the temperature change is within a predetermined value, the spectral reflectivity R (λ) is calculated using the measurement value W (λ) of the white reference plate 230 obtained in or before the previous measurement. When such control is to be performed, the number of times the white reference plate 230 is measured decreases as the temperature change becomes smaller.

Figure 8A:
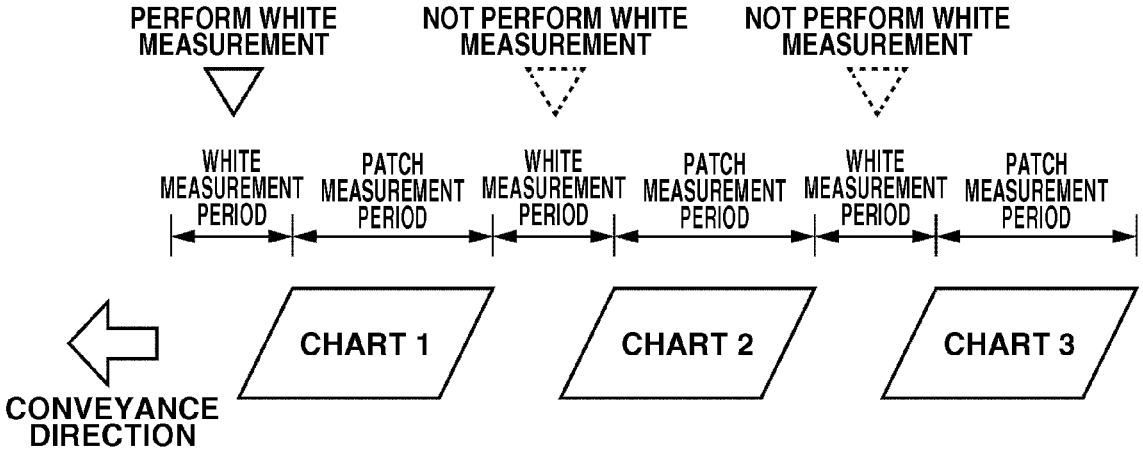
FIGS. 8A and 8B illustrate measurement of the white reference plate and the chart when the sheets on which the charts are formed are continuously conveyed.

FIG. 8A illustrates the measurement process in the case where the temperature change detected by the thermistor 240 is small. Since the temperature change is small, if the patch images on the charts are to be continuously measured, the white reference plate 230 is not newly detected during a detection period of the white reference plate 230 before the second chart or subsequent charts. In such a case, the spectral reflectivity R (λ) is calculated based on the detection result W (λ) of the white reference plate 230 obtained before measuring the first chart.

Figure 8B:
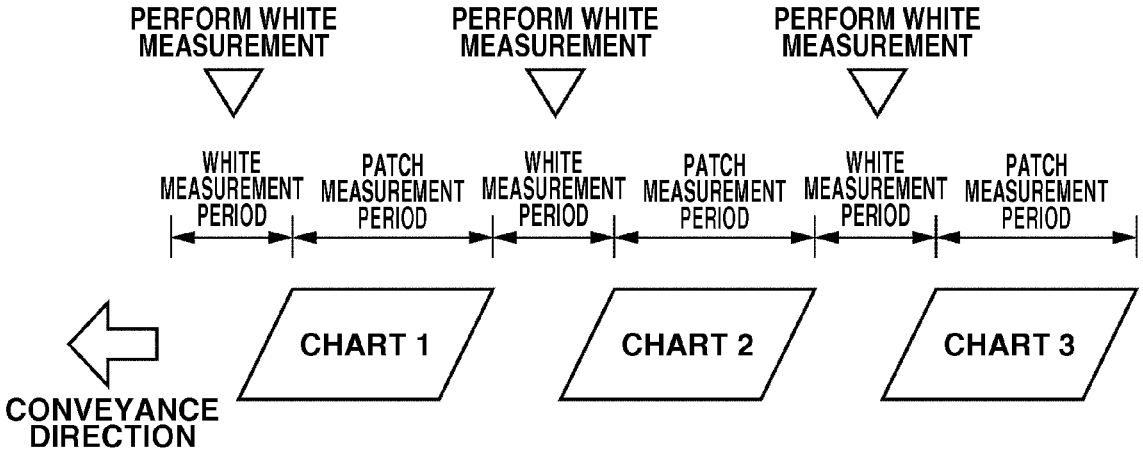

FIG. 8B illustrates the measurement process in the case where the temperature change detected by the thermistor 240 is great. In such a case, the white reference plate 230 is detected during the detection period of the white reference plate 230 before the second chart or the subsequent charts.

The spectral reflectivity R (λ) is thus calculated based on the detection result W (λ) of the detected white reference plate 230.

According to the present exemplary embodiment, the printer controller 103 performs as follows based on the temperature detected by the thermistor 240. If the temperature has changed by a predetermined temperature or more from the previous measurement of the white reference plate 230, the printer controller 103 re-measures the white reference plate 230. In contrast, if the temperature has not changed by a predetermined temperature or more, it indicates that a fluctuation in the light amount of the LED 201 is small, and the measurement accuracy is not lowered. The printer controller 103 thus does not measure the white reference plate 230.

According to the present exemplary embodiment, the thermistor 240 detects an internal temperature of the color sensor 200. However, if the thermistor 240 is arranged near the color sensor 200, the thermistor 240 may be arranged outside the color sensor 200.

As described above, according to the present exemplary embodiment, if the temperature has changed by a predetermined temperature or more from the previous measurement of the white reference plate 230, the printer controller 103 measures the white reference plate 230. Further, if the temperature has changed by less than a predetermined temperature, the printer controller 103 does not measure the white reference plate 230. As a result, the number of times the white reference plate 230 is irradiated with light is minimized, so that discoloring of the white reference plate 230 and lowering of the calibration accuracy are reduced.

Further, according to the present exemplary embodiment, the white reference plate 230 is newly measured when a predetermined number of days has elapsed from the previous measurement of the white reference plate, even if the temperature change is less than a predetermined temperature. As a result, according to the present exemplary embodiment, deterioration of the LED 201 and optical components in the color sensor 200 and discoloring with time can be corrected.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims priority of Japanese Patent Application No. 2012-182533 filed Aug. 21, 2012, which is hereby incorporated by reference herein in its entirety.

What is claimed is:

1. An image forming apparatus comprising:

an image forming unit configured to form a measurement image on a sheet;

a measurement unit configured to irradiate the measurement image with light, and measure the light reflected from the measurement image;

a white reference plate disposed in a position opposite to the measurement unit;

a correction unit configured to correct a measurement result of the measurement image, based on a measurement result of the white reference plate acquired by the measurement unit; and a temperature detection unit configured to detect temperature in a vicinity of the measurement unit, wherein the correction unit corrects, in a case where a difference between a temperature detected by the temperature detection unit and a temperature shown when previously measuring the white reference plate, is less than a predetermined value, the measurement result of the measurement image using a previous measurement result of the white reference plate, without measuring the white reference plate with the measurement unit.

2. The image forming apparatus according to claim 1, wherein the measurement unit measures measurement images formed on a plurality of sheets which is continuously conveyed, and measures the white reference plate immediately before a measurement target sheet.

3. The image forming apparatus according to claim 1, further comprising a protection member configured to protect a surface of the white reference plate and reduce discoloring.

4. The image forming apparatus according to claim 3, further comprising a moving unit configured to move the protection member to a position at which the protection member covers and protects the surface of the white reference plate, and a position at which the protection member exposes the surface of the white reference plate.

5. The image forming apparatus according to claim 4, wherein the moving unit moves, in a case where the measurement unit measures the white reference plate, the protection member to the position at which the protection member exposes the surface of the white reference plate, and moves, in a case where the measurement unit measures the measurement image, the protection member to the position at which the protection member covers and protects the surface of the white reference plate.

6. The image forming apparatus according to claim 1, wherein the temperature detection unit is disposed inside the measurement unit.

7. The image forming apparatus according to claim 1, wherein the measurement unit includes a light source configured to irradiate the measurement image with light.

8. The image forming apparatus according to claim 7, wherein the temperature detection unit is disposed on a substrate on which the light source is arranged.

9. The image forming apparatus according to claim 1, further comprising a calculation unit configured to calculate spectral reflectivity of the measurement image by correcting, based on the measurement result of the white reference plate, the measurement result of the measurement image acquired by the measurement unit.

10. The image forming apparatus according to claim 9, wherein a color correction table is generated based on the spectral reflectivity of the measurement image calculated by the calculation unit.

11. The image forming apparatus according to claim 10, wherein the color correction table is an ICC (International Color Consortium) profile.

12. The image forming apparatus according to claim 1, wherein the image forming unit forms a single color measurement image in the case of measuring density, and forms, in the case of measuring color, a measurement image in which a plurality of colors is superimposed.

13. The image forming apparatus according to claim 1, further comprising a first conversion unit configured to convert to L*a*b* data, RGB (red, green, blue) data and CMYK (cyan, magenta, yellow, black) data of an image input from outside.

14. The image forming apparatus according to claim 1, further comprising a second conversion unit configured to convert L*a*b* data to CMYK data, wherein the image forming unit forms an image on a sheet based on the CMYK data.

15. The image forming apparatus according to claim 1, further comprising a fixing unit configured to fix on a sheet the measurement image formed by the image forming unit, wherein the measurement unit is disposed downstream in a sheet conveyance direction from the fixing unit.

16. The image forming apparatus according to claim 15, wherein the image forming unit transfers toner on an image bearing member, to the sheet, and wherein the fixing unit heats and fixes toner on the sheet.

17. The image forming apparatus according to claim 15, wherein the image forming unit discharges ink and forms an image on the sheet, and wherein the fixing unit dries ink by heat.

18. The image forming apparatus comprising:

an image forming unit configured to form a measurement image on a sheet;

a measurement unit configured to irradiate the measurement image with light, and measure spectral reflectivity data corresponding to the measurement image;

a white reference plate;

a storing unit configured to store spectral reflectivity data corresponding to the white reference plate;

a correction unit configured to correct the spectral reflectivity data corresponding to the measurement image measured by the measurement unit, based on the spectral reflectivity data corresponding to the white reference plate stored in the storing unit;

an acquiring unit configured to acquire temperature information of the measurement unit; and a controller configured to control whether to update the spectral reflectivity data corresponding to the white reference plate stored in the storing unit, based on the temperature information acquired by the acquiring unit, in a case where the measurement unit measures the spectral reflectivity data corresponding to the measurement image.

19. The image forming apparatus according to claim 18, wherein in a case where the controller updates the spectral reflectivity data corresponding to the white reference plate, the measurement unit measures the spectral reflectivity data corresponding to the white reference plate by irradiating the white reference plate with light.

20. The image forming apparatus according to claim 18, wherein in a case where difference between the temperature of the measurement unit when previously measuring the spectral reflectivity data corresponding to the white reference plate, and a current temperature of the measurement unit, is larger than a threshold value, the controller updates the spectral reflectivity data corresponding to the white reference plate.

* * * * *